US005695067A

United States Patent [19]

Harvey

[11] Patent Number: 5,695,067

[45] Date of Patent: Dec. 9, 1997

[54] BAT BAG

[76] Inventor: Eugene Harvey, 4120 Flansburg Rd., Jackson, Mich. 49203

[21] Appl. No.: 723,154

[22] Filed: Sep. 30, 1996

[51] Int. Cl.[6] ..... A45C 11/00

[52] U.S. Cl. ..... 206/579; 206/315.1; 206/315.9

[58] Field of Search ..... 190/109; 206/315.1, 206/315.9, 579, 472

[56] References Cited

U.S. PATENT DOCUMENTS

| | | | |
|---|---|---|---|
| 2,767,758 | 10/1956 | Haynes | 206/315.1 |
| 3,933,241 | 1/1976 | Tassone et al. | 206/315.1 |
| 4,793,532 | 12/1988 | Cash | 224/202 |
| 4,842,134 | 6/1989 | Chang | 206/315.1 |
| 4,890,731 | 1/1990 | Mroz | 206/305.9 |
| 5,224,602 | 7/1993 | Bettles et al. | 206/579 |
| 5,356,002 | 10/1994 | Brown | 206/315.1 |

*Primary Examiner*—Jimmy G. Foster
*Attorney, Agent, or Firm*—Patent & Trademark Services; Joseph H. McGlynn

[57] ABSTRACT

A storage and tote bag for baseball and softball bats and balls. The device is a soft, zippered bag which stores bats by allowing them to lay flat along the bag's length and stores balls in the bottom of the bag. Once filled with bats and balls, the bag can be closed for storage and transportation. The device is composed of a fabric casing, lined with padding, which is folded along the width and secured with a zipper so that a closed container is formed. This closed container, or bag, can hold a plurality of bats, when they are laid along the bag's length, and a plurality of balls, when placed in a stiffener in the region of the bag's fold. The padding has straps and pockets for securing the bats. The stiffener has indentations to secure the balls. When empty, the bag can easily be folded into a smaller size for easy storage of the device itself. The bag also has a handle and strap on the outside so that it can be carried easily when closed and filled.

8 Claims, 1 Drawing Sheet

FIG. 1
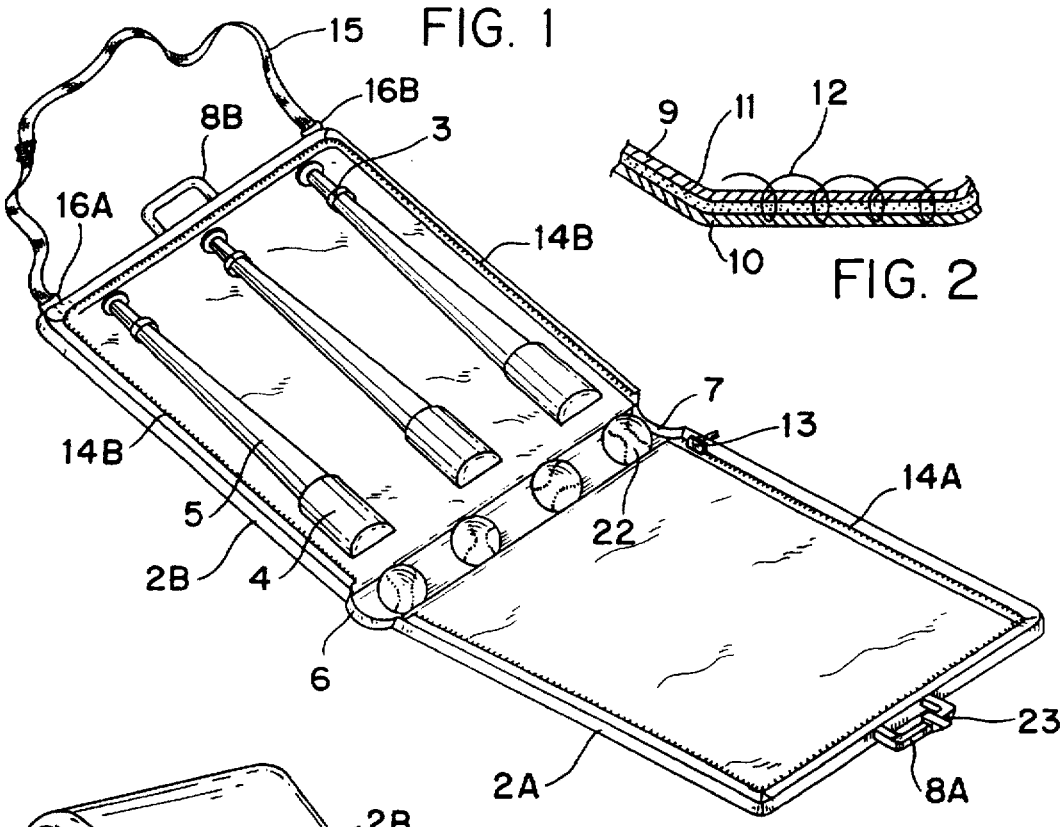
FIG. 2
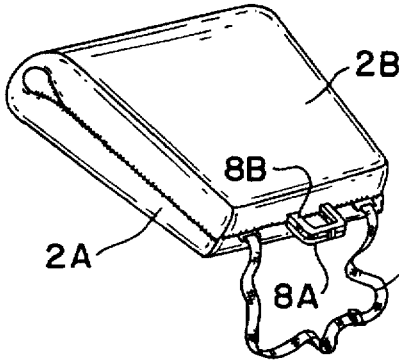
FIG. 4
FIG. 3
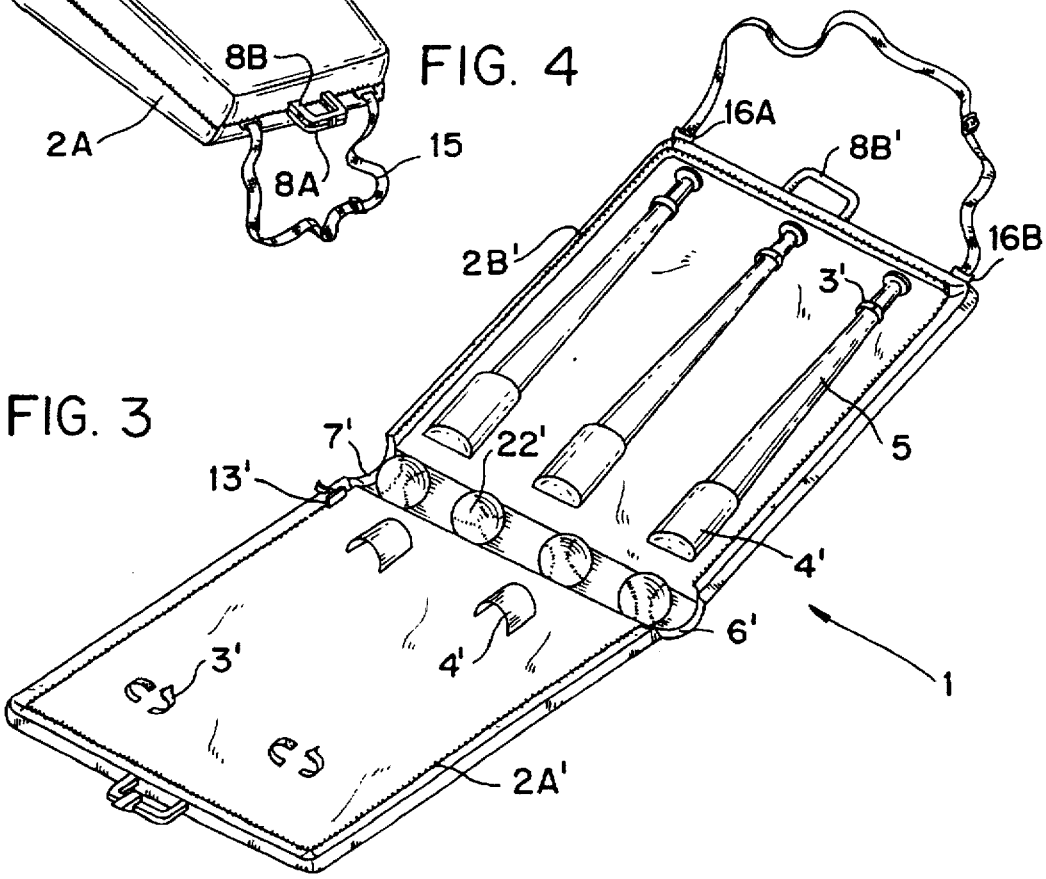

BAT BAG

BACKGROUND OF THE INVENTION

This invention relates generally to ball game items, such as baseball and softball bats and balls, and, more particularly, their storage and carriage in soft carry bags.

DESCRIPTION OF THE PRIOR ART

Numerous inventions relating to the storage and carriage of baseball and softball bats and balls have been proposed in the prior art. Often, they seek to organize baseball and softball bats and balls for storage in containers equipped for carriage.

U.S. Pat. No. 4,793,532 discloses a carrier for ball game items. The invention consists of a removable bottom containing a compartment for containing balls, and a sidewall containing compartments for individual bats.

U.S. Pat. No. 4,890,731 discloses a personal sports equipment carrier adapted for carrying baseball or softball equipment. The sports equipment carrier has a rigid frame with recesses formed in it to receive bats. Balls may be positioned in the bottom of the rigid frame. Eyelets and/or VELCRO hook and loop fasteners allow for reception of the strap of a baseball glove and/or the tied-together laces of shoes. A handle is secured to the rigid frame so that a person may carry equipment.

U.S. Pat. No. 5,224,602 discloses a case for carrying baseball bats and balls. The case also serves as a bat rack and ball dispenser when opened at the playing field. A rigid hinged case has bat racks which maintain the bats in parallel relationship when the case is being carried, and a gravity feed ball dispenser.

U.S. Pat. No. 5,356,002 discloses a sport utility bag which includes a plurality of individually accessible compartments. The bag comprises an elongate compartment extending along a length of said utility bag designed to securely carry a rod-shaped object such as a bat. The bag prevents items from cluttering and interfering with each other, and ensures that dirt from certain items does not contaminate other items.

Most of the prior art storage cases have been formed only as hard cases, often failing to completely contain and enclose the stored ball game items. There remains a need for a device aimed at the carriage of ball game items in a lightweight and flexible soft storage case.

SUMMARY OF THE INVENTION

The present invention is a storage and tote bag for baseball and softball bats and balls. The device is a soft, zippered bag which stores bats by allowing them to lay flat along the bag's length and stores balls in the bottom of the bag. Once filled with bats and balls, the bag can be closed for storage and carriage.

The device is composed of a fabric casing, lined with padding, which is folded along the width and secured with a zipper so that a closed container is formed. This closed container, or bag, can hold a plurality of bats, when they are laid along the bag's length, and a plurality of balls, when placed in a stiffener in the region of the bag's fold. The padding has straps and pockets for securing the bats. The stiffener has indentations to secure the balls. When empty, the bag can easily be folded into a smaller size for easy storage of the device itself. The bag also has a handle and strap on the outside so that it can be carried easily when closed and filled.

Accordingly, it is an object of this invention to allow easy storage of baseball and softball bats and balls in an organized fashion.

It is a further object of this apparatus to allow easy carriage of this ball game equipment.

Finally, it is an object of this apparatus to promote lightweight and durable protection for this ball game equipment.

BRIEF DESCRIPTION OF THE DRAWINGS

FIG. 1 shows a perspective view of the bag in the opened position.

FIG. 2 shows a partial sectional view of the bag.

FIG. 3 shows a perspective view of an alternate embodiment of the device.

FIG. 4 shows a perspective view of the bag in the closed position.

DESCRIPTION OF THE PREFERRED EMBODIMENT

Referring now to the drawings, there is shown in FIG. 1 a view of the present invention I comprising two regions 2A/2B of a continuous piece of fabric material. The upper portion of the device 2B has on it provisions for securing baseball and softball bats 3,4, including a VELCRO hook and loop fastener 3 and a cup shaped pocket 4. The two portions of the device 2A, 2B can be brought together by folding along a width wise recess 7 and joined at a handle portions 8A, 8B. The two part handle portions 8A, 8B can be secured together by a latch 23. The bat bag can be further secured in the closed position by using a metal fastener 13, such as a zipper, to join the tracks of metal teeth 14A and 14B. As with a standard metal fastener system, the rows of metal teeth 14A and 14B are interlocked by the fastener 13. As the metal teeth 14A, 14B are sowed into the main fabric portions 2A, 2B, fastening them together brings the two portions 2A, 2B together, as shown in FIG. 4, thereby closing the bag.

The continuous fabric portion of the bag 2A/2B can be composed of canvas or woven nylon fabrics, however other materials can be used without departing from the scope of the invention. The bag may be made using stitching 12 used to sew an inner fabric layer 9 to an outer fabric layer 10, with a padding layer 11 in between the two, as shown in FIG. 2. The inner 9 and outer fabric layers 10 do not have to be of the same type of fabric material, but each should be strong enough to resist tearing or puncture. The outer layer 10 should also be easily cleaned.

The padding layer 11 could be made of any material that is sufficiently loosely packed to allow easy compression, as are many foam paddings. By using these materials, namely fabrics and foams, the bag is created to be extremely lightweight.

In use, the bag is left in the opened position, as shown in FIG. 1, and bats 5 are stored in the bag, so that the barrel of the bat rests in the pocket/cup 4, and the handle is secured using VELCRO hook and loop fasteners 3. A plurality of bats may be inserted, in a mutually parallel relationship. For proper insertion, the bat's barrel should be inserted into the pocket/cup 4 first, thus deforming the padding 11 underneath the bat. Then the handle of the bat can be secured using the Velcro hook and loop fasteners 3. Of course other types of fasteners, such as but not limited to elastic straps, can be used without departing from the scope of the invention.

When the bag is in the open position, baseballs and softballs may also be stored in the bag, withinin the recess 7 between the two portions 2A/2B. The recess 7 contains a stiffener 6 of any suitably stiff and sturdy material, such as thick cardboard, which allows for a plurality of indentations 22 in the shape and size of a baseball or softball. In use, balls are placed in the indentations 22 while the bag is in the open position. The fabric material in this region lacks the foam core 11 of the other areas, thereby allowing the balls to fit close to the outer layer of fabric 10, thereby allowing the bag to be closed without disruption or distortion of its shape.

As the bag is closed, the latch 23, composed of a continuous fabric piece, is drawn through both handles 8A/8B. The latch 23 is then secured into a position of a closed loop by a snap 24A/24B. In this way, the two handle pieces 8A/8B are secured together, so that the bag may be carried by the handle 8 when closed. The handles may be made of any material which is sufficiently strong to withstand the weight of the bag in its fully loaded condition. One possibility for the handle is injection molded plastic.

Injection molding is a plastic molding procedure whereby heat softened plastic material is forced under very high pressure into a metal cavity mold which is relatively cool. Acceptable metals for the mold are aluminum and steel. The inside cavity of the mold is comprised of two or more halves, and is the same desired shape as the product to be formed. High pressure hydraulics are used to keep the mold components together during the actual injection phase of the molding process. The injected plastic is allowed to cool and harden. The hydraulics holding the multiple component cavity together are released, the halves of the mold are separated and the solid formed plastic item is removed. Injection molding can be a highly automated process and is capable of producing extremely detailed parts at a very cost effective price. The latch may be of any durable fabric, and the snap should be a metal alloy which is suitably durable.

Alternatively, in the closed position, the bag can be carried by a shoulder strap 15. The strap 15 is composed of a length of fabric, joined to two eyelets or rings 16A,16B. This attachment is accomplished by feeding the strap 15 through the eyelet or rings 16A,16B, and then stitching the ends over the rings. In this way, the strap 15 is stitched into a loop containing the eyelet 16A/16B. By thus attaching the strap to both eyelets, it is securely affixed to the bag. As with the fabric for the bag's casing, the strap may be of nearly any material, so long as it is strong and durable.

The materials involved in the bag's construction are not required to be of any particular composition or shape. Instead, it should be understood that the materials will be chosen only on their ability to meet the aforementioned criteria. The bag's construction also requires the use of numerous stitching processes. A few of these methods and techniques are commonplace and easily understood by all. Easestitching is a technique used to join a longer fabric edge to a slightly shorter one. This technique is similar to the type used for gathering, but there should be no folds or gathers visible on the outside of the bag once the seam is stitched. Edgestitching is a technique forming an extra row of regulation-length stitches appearing on the outside of a bag. It is placed approximately ⅛" (3 mm) or less away from a seam-line or a fold-line, or close to a finished edge. This type of stitch is similar to a topstitch but is less noticeable because it is closer to the edge and is always performed in matching thread.

Reinforcement stitching is a technique for strengthening the stitching areas that will be closely trimmed, such as corners or along deep curves that will be clipped or notched at frequent intervals. The basic premise is that a shorter stitch length is used.

Staystitching is a line of regulation stitching preventing curved or bias edges, such as necklines, shoulders and waistlines, from stretching out of shape as they are handled. Staystitching requires a regulation length stitch of one half inch from the cut edge of the fabric.

Stitch-in-the-ditch is a technique which allows a quick way to hold layers of fabric in place at the seams. It is an effective way to secure neckline, armhole, or waistband facing as well as fold up cuffs.

Topstitching is a technique forming an extra row of stitching on the outside of the bag along or near a finished edge. Although topstitching is usually added as decoration, it can also be functional. Understitching is a technique forming a row of stitching which prevents an inside layer of fabric, usually a facing, from rolling to the outside of the bad.

Understitching is performed after the seam allowances are trimmed, graded and clipped or notched. Seams are the backbone of a finished manufactured product. A seam is basically a line of stitching that joins two or more layers of fabric. Seams are stitched on the seam line. The seam allowance is the distance between the seam line and the cut edge. There are several types of seams. The double-stitch seam is a combination seam and edge finish that creates a narrow seam especially good for sheer fabrics and knits. This seam prevents the fabric from raveling and is stitched twice. A plain seam consists of right sides together, stitched along the seam line, which is usually ⅝" from the cut edge, with a regulation length stitch. Stretch knits need seams that are supple enough to give with the fabric. These fabrics may be manufactured with straight stitches, zig zag stitches or one of the stretch stitches which are found in many factories.

Flat-felled seams are frequently used on sportswear, men's wear and reversible bags. These seams are accomplished by bringing wrong sides of the fabric together and stitching a plain seam, pressing the seam allowances to one side.

The French seam adds a contour look to the inside of bags made from sheers and lightweight silks. The finished seam which is very narrow, completely encloses the raw edges of the seam allowances.

Lapped seams are frequently used on non-woven fabrics, such as synthetic suede and leather, as well as real suede and leather, because their edges do not fray.

Topstitched seams accent seam lines. They also help keep the seam allowances flat—a great benefit when working with crease resistant fabrics.

As an alternate embodiment, the bag can store bats on both sides of the case, thereby storing a greater number of bats. As shown in FIG. 3, the device's alternate embodiment has the same continuous fabric design, again folded in the center 7'. A stiffener 6' is inserted with holes 22' for balls to be stored. However, in this embodiment, the protective pockets 4' for the barrel and the VELCRO hook and loop fastener straps 3' for the handle of a bat to be stored are located on both the upper 2B' and lower 2A' pieces of the bag. The handle mechanism 8A'/8B', strap 15' and handle lock 23' are the same as in the original embodiment, as is the closure system employing tracks of metal teeth 14A', 14B' connected by a metal fastener 13'.

The materials for the alternate embodiment have the same requirements as those in the original embodiment. As such, they will be similar and, likely, identical, to those in the original embodiment.

Although the bat bag and the means of using the same according the present invention have been described in the foregoing specification with considerable detail, it is to be understood that modifications may be made to the invention which do not exceed the scope of the appended claims, and modified forms of the present invention done by others skilled in the art to which the invention pertains will be considered infringements of the invention when those modified forms fall within the claimed scope of this invention.

What I claim as my invention is:

1. A carrying case for sports equipment comprising:

a container having a first part and a second part, said first and second parts having substantially the same width, length and depth, one of said first and second parts having means for securing bats thereon, a third part unitarily secured between said first and second parts, said third part having a smaller depth than said first and second parts, whereby said third part acts as a hinge between said first and second parts which allows said first and second parts to be folded upon each other, said third part having means for securing balls thereon, means for securing said first and second parts together after they are folded upon each other.

2. The carrying case for sports equipment as claimed in claim 1, wherein said means for securing bats is a rigid semi-circular element which will receive one end of a bat, and a detachable fastening means for securing another end of said bat.

3. The carrying case for sports equipment as claimed in claim 1, wherein both said first and second parts have means for securing bats thereto.

4. The carrying case for sports equipment as claimed in claim 1, wherein said first and second parts are made with two layers and there is padding secured between said two layers.

5. The carrying case for sports equipment as claimed in claim 1, wherein said means for securing balls is a series of depressions in said third part.

6. The carrying case for sports equipment as claimed in claim 1, wherein said first and second parts have carrying handles secured thereto, and a fastening means for securing said handles together.

7. The carrying case for sports equipment as claimed in claim 1, wherein one of said first and second parts has a shoulder strap secured thereto.

8. The carrying case for sports equipment as claimed in claim 1, wherein said means for securing said first and second parts together after they are folded upon each other is a zipper.

* * * * *